US006434989B1

(12) United States Patent
Hardtke

(10) Patent No.: US 6,434,989 B1
(45) Date of Patent: Aug. 20, 2002

(54) METHOD AND DEVICE FOR PRODUCING LEADTHROUGHS ON HOLLOW PROFILES

(75) Inventor: Uwe Hardtke, Neu Wulmstorf (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/883,982

(22) Filed: Jun. 20, 2001

(30) Foreign Application Priority Data

Jun. 20, 2000 (DE) ..... 100 29 319

(51) Int. Cl.[7] ..... B21D 28/28; B21D 26/02

(52) U.S. Cl. ..... 72/55; 72/58; 72/61; 83/53; 29/421.1

(58) Field of Search ..... 72/55, 56, 336, 72/58, 61; 83/22, 53, 177; 29/421.1

(56) References Cited

U.S. PATENT DOCUMENTS 5,666,840 A * 9/1997 Shah et al. ..... 72/336
5,799,524 A * 9/1998 Schafer et al. ..... 29/421.1
5,884,722 A * 3/1999 Durand et al. ..... 29/897.2
6,098,437 A * 8/2000 Kocer et al. ..... 72/55
6,158,122 A * 12/2000 Skudutis ..... 29/421.1
6,305,201 B1 * 10/2001 Ghiran et al. ..... 72/55

FOREIGN PATENT DOCUMENTS

DE 195 30 055 A1 2/1997

* cited by examiner

*Primary Examiner*—David Jones
(74) *Attorney, Agent, or Firm*—Crowell & Moring LLP

(57) ABSTRACT

A method and a device for producing leadthroughs on hollow profiles acted upon by a high fluidic pressure in an internal high-pressure forming tool. Dome-like secondary shaped elements are formed outwards in a radial direction from this hollow profile by the fluid pressurizing. The secondary shaped elements are then reverse drawn into the interior of the hollow profile by a punch while held at the prevailing internal high pressure, whereupon, to open the leadthrough, a punched slug is cut out of the base of the reverse-drawn secondary shaped element by the punch. To ensure the process reliability when producing the leadthrough even in the case of a hollow-profile material having low formability and to retain the strength of the hollow profile in the transition region to the leadthrough, in each case a secondary shaped element is formed out of the hollow profile at two opposite locations. After the forming, the secondary shaped elements are each reverse drawn into the hollow profile interior by a punch in such a way that the bases come to bear against one another inside the hollow profile in the final state of the reverse drawing. The punched slug is severed from the respective base by one punch plunging into the other punch.

32 Claims, 4 Drawing Sheets

METHOD AND DEVICE FOR PRODUCING LEADTHROUGHS ON HOLLOW PROFILES

BACKGROUND AND SUMMARY OF THE INVENTION

The invention relates to a method of producing leadthroughs on hollow profiles, the hollow profile being acted upon by a high fluidic pressure in an internal high-pressure forming tool, and a dome-like secondary shaped element being formed outwards in the radial direction from this hollow profile by the fluid pressurizing, whereupon the secondary shaped element is reverse drawn into the interior of the hollow profile by means of a punch at the prevailing internal high pressure, whereupon, to open the leadthrough, a punched slug is cut out of the base of the reverse-drawn secondary shaped element by means of the punch. The invention also relates to a device for carrying out this method.

A method or a device of the generic type has been disclosed by German Patent Document DE 195 30 055 A1 (corresponding U.S. Pat. No. 5,799,524). To form bearing bosses on transverse links or double-transverse-link front axles of motor vehicles, a reverse-drawing process operated with fluidic internal high pressure is described here. In this case, dome-like necking is formed out of a hollow body under internal high pressure, this dome-like necking being reverse drawn by a punch in a central region into the interior of the hollow profile against the internal high pressure. The reverse drawing is effected until the necking wall acted upon by the punch comes to bear against the opposite wall of the hollow profile. Up to that point, the opposite wall is supported in a fixed position by a counterstay punch. Once the walls come to bear against one another, the counterstay punch is retracted. The punch which hitherto served for the reverse drawing is advanced further, in the course of which, by means of a cutting edge, it cuts off that part of the necking wall which is acted upon. The wall supported by the counterstay punch is sheared off via a sharp edge of the leadthrough in which the counterstay punch is guided. In a further forward movement, the reverse-drawing punch presses the bent-in margin of the necking cutout outwards and at the same time presses it against the opening margin of the cutout opening of the hollow-profile wall opposite the necking. This type of reverse drawing is not possible in some applications, since the hollow-profile material cannot apply the requisite expansions during the forming on account of its material properties and/or the geometrical dimensions of the leadthrough to be produced (excessive height), as a result of which cracks or fractures may therefore occur in the process, so that the process reliability in the method of producing such leadthroughs or bearing bosses is not ensured. Furthermore, due to the generous reverse drawing, the thickness of the hollow-profile material is greatly reduced in the transition region from the leadthrough to the surrounding component, as a result of which the strength of the leadthrough is adversely affected, this strength being absolutely necessary in some practical applications for attaching further components, for example, shock absorbers, or for making a bearing bush in the leadthrough.

An object of the invention is to develop a method of the generic type and a device of the generic type to the effect that the process reliability when producing the leadthrough is ensured even in the case of a hollow-profile material having low formability and the strength of the hollow profile in the transition region to the leadthrough is retained.

According to the invention, this object is achieved with regard to the production method by providing a method of the above noted type, wherein in each case a secondary shaped element is formed out of the hollow profile at two opposite locations, wherein the respective secondary shaped elements each are reverse drawn after the forming, into the hollow profile interior by a punch in such a way that their bases come to bear inside the hollow profile in the final state of the reverse drawing, and wherein the punched slug is severed from the respective base by one punch serving as a plunging punch plunging into the other punch.

According to the invention this object is also achieved by providing a device for producing leadthroughs on hollow profiles, comprising an internal high-pressure forming tool which has a branch branching off radially from a tool impression for forming a dome-like secondary shaped element by fluidic pressurizing, and a punch which is guided in the branch of the impression and by means of which the secondary shaped element can be reverse drawn into the interior of the hollow profile at the prevailing internal high pressure, and, after the reverse drawing, a punched slug can be severed from the base of the reverse-drawn secondary shaped element, wherein two branches are formed in the forming tool and are arranged on two opposite sides of the impression, wherein in each case a punch for the reverse drawing of in each case one secondary shaped element is guided in the two branches, wherein the punches are controlled in such a way that, after the end position during the reverse-drawing operation has been reached, the bases of the secondary shaped elements bear against one another inside the hollow profile, wherein one of the punches comprises a sleeve, the inside diameter of which sleeve is larger than the outside diameter of the opposite punch in alignment with the clear width of the sleeve, and furthermore contains a support which is guided inside the sleeve and on which the base of the associated secondary shaped element can be supported, and wherein the punch, for severing punched slugs from the bases of the secondary shaped elements, can be moved into the sleeve, whereas the support is controlled in such a way that it gives way outwards when the punch plunges into the sleeve.

Thanks to the invention, due to the smaller drawing length, now required, of the secondary shaped element or of the necking and smaller reverse-drawing travel, the transition region to the leadthrough is subjected to considerably less loading by a reduction in thickness of the material, so that the strength of the hollow profile there is sufficiently ensured. Furthermore, the use of materials which have only low extension properties and low elastic limits and therefore had to be ruled out in the case of the known methods is thus possible for the hollow profile. Since the risk of cracks in the hollow profile no longer occurs on account of the reduced tensile stress, the process reliability is ensured. By the separation of the punched slug in the punch receiving the plunging punch, the punched slug, in a simple manner, can either be removed via the punch from the impression of the internal high-pressure forming tool or pushed back into the cutout opening of the secondary shaped elements and removed upon removal of the component, so that the problem occurring in other methods with the removal of the punched slug from the impression can easily be rectified and the process reliability for subsequent forming operations is ensured due to the fact that there are no overlooked punched slugs in the impression or there are no punched slugs in the impression which are jammed at locations of the impression where access is difficult. On account of the active mechanical punching by interaction between two punches, very small hole diameters can also be produced, in contrast to punching operated solely by internal high pressure.

Expedient configurations of the invention may be gathered from the description and the claims.

Other objects, advantages and novel features of the present invention will become apparent from the following detailed description of the invention when considered in conjunction with the accompanying drawings.

DETAILED DESCRIPTION OF THE DRAWINGS

Figure 1:
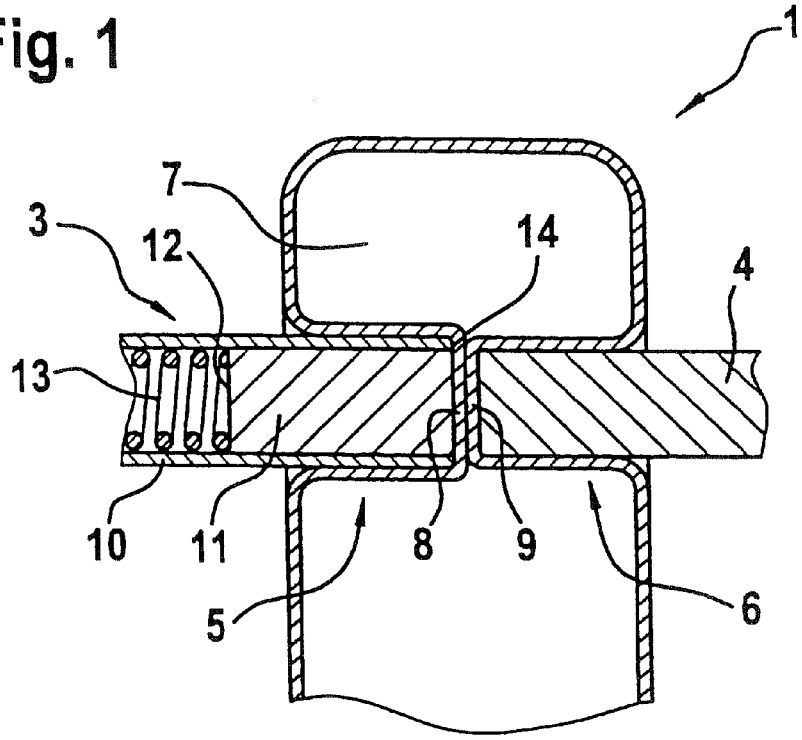
FIG. 1 shows a lateral longitudinal section of a hollow profile which is reverse drawn on both sides according to the invention before the punching operation, one of the reverse-drawing punches being in two pieces.
Figure 1A:
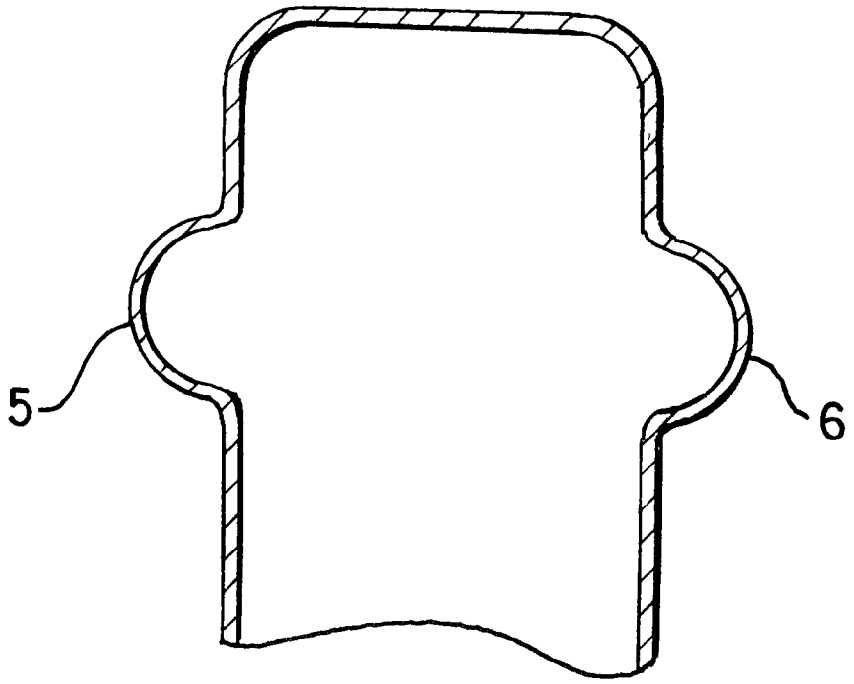
FIG. 1A is a lateral longitudinal section of the hollow profile of FIG. 1, shown before it is reverse drawn.

Shown in FIG. 1 is a hollow profile 1 which may be, for example, a chassis axle or strut or a lightweight pedal of a motor vehicle. To produce leadthroughs 2 in the hollow profile 1, which relate to the rotary mounting in the case of the pedal or locating bores or bushes in the chassis region, the hollow profile 1, if need be formed in a preforming tool, is inserted into an internal high-pressure forming tool. The impression of the forming tool has radial branches at two opposite locations, one branch being provided with a larger diameter than the other branch. FIG. 1A schematically depicts the profile 1 after high-pressure forming and before the reverse drawing step, showing dome-like elements 5, 6.

Two punches 3 and 4 are guided with slight clearance in the branches and are used for the subsequent reverse drawing. By the admission of high pressure fluid inside the hollow profile 1, two dome-like secondary shaped elements 5 and 6 are formed on the hollow profile 1 according to the branches of the impression, the punches 3 and 4 being effective as counterstays. The punches 3 and 4—while ensuring the accuracy to shape of the subsequent leadthrough, preferably at the prevailing internal high pressure—then press back the secondary shaped elements 5 and 6 and reverse draw them into the hollow-profile interior 7. The reverse drawing, on account of the greater material accumulation produced as a result of the doming of the secondary shaped elements, avoids a reduction in the thickness of the hollow-profile material at the location of the reverse drawing, this reduction in thickness entailing the risk of cracking, and achieves a greater controlled plunge depth of the punches 3 and 4.

Through the use of two punches 3 and 4, which perform the reverse drawing from both sides of the hollow profile 1, the maximum plunge depth of an individual punch which is required for achieving a leadthrough 2 is at least halved and thus greater process reliability during the production process is ensured. In this case, materials of the hollow profile 1 which are unable to apply the necessary expansions during forming with a single punch may also be used. The punches 3 and 4 are controlled during the reverse-drawing operation in such a way that, after the final position of the reverse drawing has been reached, the bases 8 and 9 of the secondary shaped elements 5 and 6 inside the hollow profile 1 bear flat against one another. The punch 3 guided in the branch having the larger diameter consists of a sleeve 10, the inside diameter of which is larger than the outside diameter of the opposite punch 4, which is in alignment with the clear width of the sleeve 10.

Furthermore, the punch 3 contains a plunger 11 which is guided with slight clearance in the sleeve 10 of the punch 3 and forms a supporting means for the base 8 of the secondary shaped element 5. The plunger 11 corresponds in the dimensioning of its outer contour to that of the punch 4. In this exemplary embodiment, the plunger 11 is supported in a spring-loaded manner (helical spring 13) on its side 12 facing away from the hollow profile, but may alternatively also be provided at this location with a pneumatic or hydraulic drive. By means of the pneumatics or the hydraulics, the plunger 11 can advantageously give way in a controlled manner in relation to the situation and in such a way as to meet the requirements. The spring force of the helical spring 13 is rated in such a way that the end face of the plunger 11 terminates flush with the end face 14 of the sleeve 10 during the reverse-drawing operation. The end face 14 of the sleeve 10 is rounded at the outer edge 15, so that no undesirable notching effect occurs during the reverse drawing.

Figure 2:
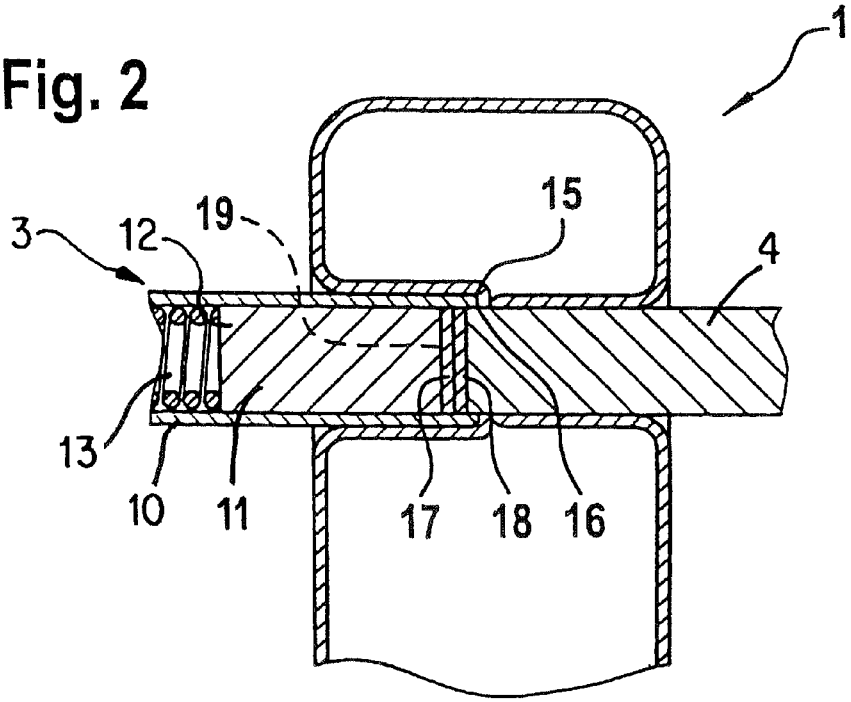
FIG. 2 shows a lateral longitudinal section of the hollow profile from FIG. 1 after the punching.

However, the inner edge 16 is designed as an encircling sharp cutting edge. It is also conceivable for the encircling cutting edge to be arranged on the punch 4 instead, in which case the sleeve-shaped cutting edge must be designed to be extendable from the punch 4. As shown in FIG. 2, the punch 4 is now advanced in order to punch the bases 8 and 9, the punch 4 pushing back the plunger 11 in the process, whereas the sleeve 10 remains in the reverse-drawing position. In the process, the bases 8 and 9 are separated by the punch 4, plunging into the sleeve 10 of the punch 3, at the cutting edge 16, as a result of which two holes lying directly one behind the other are produced in the hollow profile 1 on the one hand and two punched slugs 17 and 18 are produced on the other hand. The leadthrough 2 is thus opened.

It is of course also contemplated by the invention for there to be no cutting edge in a simpler design of the punch 3 and for the shearing force of the punch 4 at the inner edge 16 of the sleeve 10 to be sufficient to tear the punched slugs 17 and 18 out of the bases 8, 9 of the secondary shaped elements 5 and 6 solely by the plunging movement of the plunging punch 4 while the sleeve 10 remains in the bearing position. The punched slugs 17,18 are pressed by the plunging movement into a receiving hollow which is formed on one of the end faces of the punches 3,4. In the present case, the receiving hollow is formed by the cavity 19 inside the sleeve 10, this cavity 19 being produced when the plunger 11 gives way during the punching operation. After the internal high pressure has expanded inside the finish-formed hollow profile 1, the punches 3 and 4 are retracted, the internal high-pressure forming tool is opened, and the punched slugs 17, 18 are deliberately removed from the tool by withdrawing the plunger 11, which now serves as an ejector pin. Punched slugs are thus prevented from remaining in the tool and putting the following forming processes at risk.

Alternatively, after being severed, the punched slugs 17, 18 can be pushed back again into the produced hole by means of the plunger 11 while the plunging punch 4 gives way, in which case, after the finish-formed hollow profile 1 has been removed from the internal high-pressure forming tool, the respective punched slug 17, 18 is pushed out of the hole by means of a pin or by vacuum.

Figure 3:
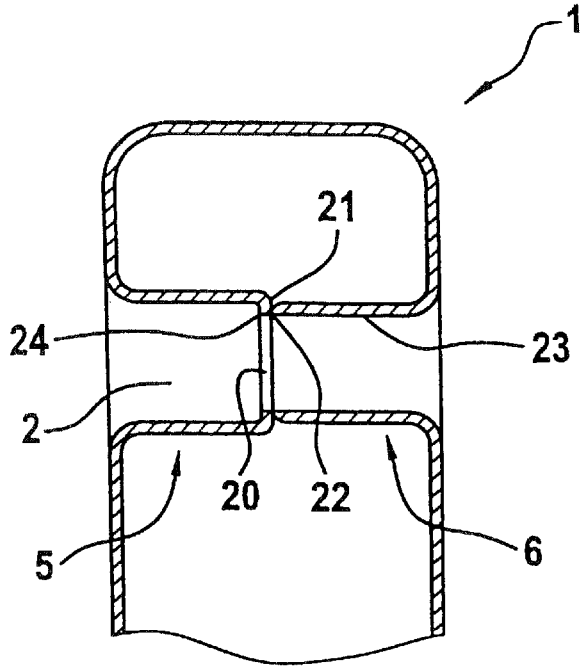
FIG. 3 shows a lateral longitudinal section of the finished hollow profile from FIG. 1.

The finish-formed hollow profile 1 according to FIG. 3 now has a leadthrough 2 which has two different cross-sectional diameters, the larger diameter being that of the secondary shaped element 5 and the smaller diameter following directly in the punched hole 20 produced being that of the secondary shaped element 6. Whereas a bent-in margin 21 of the base 8 of the secondary shaped element 5 still remains, the base 9 of the secondary shaped element 6 is completely severed. The connection between the secondary shaped elements 5 and 6 is based merely on the fact that the encircling terminating edge 22 of the secondary shaped element 6 abuts transversely on the margin 21, the inside 23 of the secondary shaped element 6 terminating flush with the edge 24 of the margin 21. For fitting the hollow profile 1 to further components, it is therefore expedient to insert a stepped connecting pin or screw into the leadthrough 2 stepped in this way.

In order to form a more rigid and more stable connection between the secondary shaped elements 5 and 6 and thus provide for greater stability and improved rigidity of the leadthrough, the secondary shaped elements 5 and 6 are clamped to one another. Although this is likewise possible in the same manner in the embodiment explained above, the procedure for this is to be explained in more detail in the exemplary embodiment described below.

Figure 4:
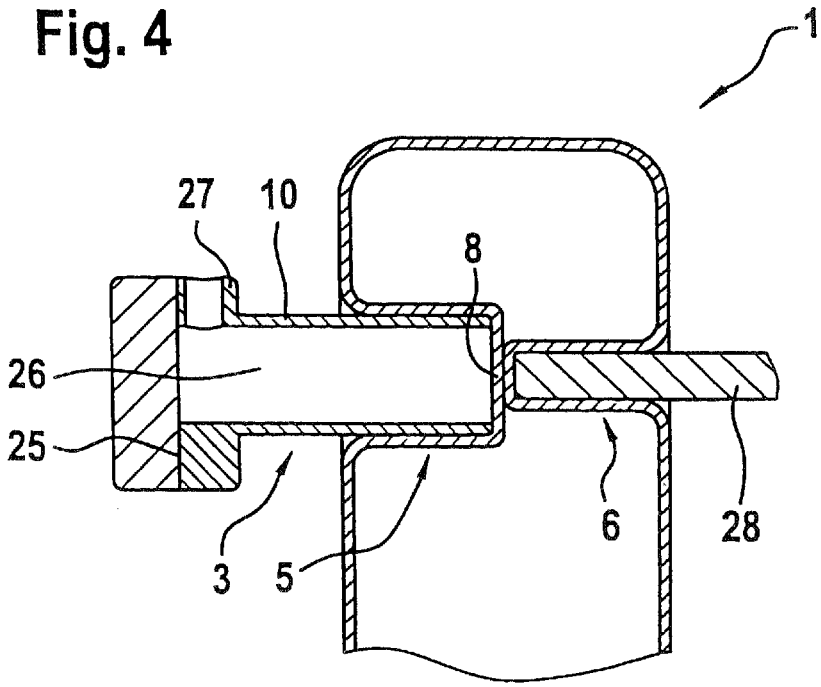
FIG. 4 shows a lateral longitudinal section of a hollow profile which is reverse drawn on both sides according to another embodiment of the invention shown before the punching operation, one of the reverse-drawing punches being designed merely as a sleeve.

Unlike the exemplary embodiment described, the punch 3, as shown in FIG. 4, consists merely of a sleeve 10. This sleeve 10 is connected to a controllable fluid-pressure generator on the side 25 remote from the base 8 of the reverse-drawn secondary shaped element 5. As soon as the punch 3 bears against the hollow profile 1, a pressure fluid is directed into the punch interior 26 via the fluid connection 27 and pressurized. The supporting means in this case is formed by the pressure fluid itself, against which the secondary shaped element 5 bears at the end face. The applied pressure corresponds to the pressure of the counterstay, which supports the hollow profile 1 during the doming forming operation in such a way as to give way successively outwards. Under a pressure which exceeds the forming pressure prevailing in the hollow profile 1, the secondary shaped element 5 according to FIG. 4 is reverse drawn, while a punch 28 located opposite in place of the punch 4 reverse draws the hollow profile 1. The punch 28 has an outside diameter which is smaller than the inside diameter of the sleeve 10 by at least twice the wall thickness of the hollow profile 1.

Figure 5:
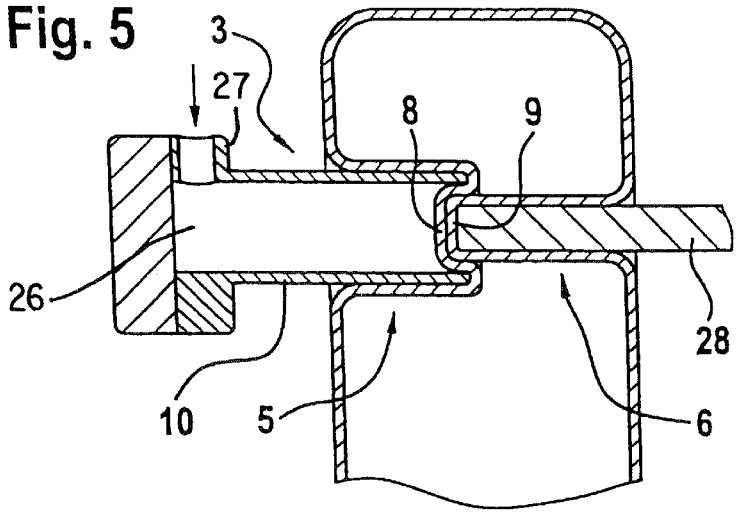
FIG. 5 shows a lateral longitudinal section of the hollow profile from FIG. 4 during the plunging of the reverse-drawing punch into the sleeve-shaped punch with internal plunger.

The end position of the sleeveless punch 28 during the reverse-drawing operation is reached inside the sleeve 10 of the opposite punch 3 (FIG. 5). In the first phase of the plunging movement, due to the shape of the punch 28, the secondary shaped element 6 formed by it is pushed into the opposite secondary shaped element 5 while pushing back its base 8. To this end, the fluid pressure inside the sleeve 10 is reduced to such an extent that this fluid pressure allows the punch 28 to plunge in with a tolerable force. In the process, the base 9 and the adjoining wall region of the secondary shaped element 6, on account of the abovementioned spacing between the punch 28 and the sleeve 10, are enclosed collar-like in a clamping manner by the likewise pushed-back base 8 and the adjoining wall region of the secondary shaped element 5.

Figure 6:
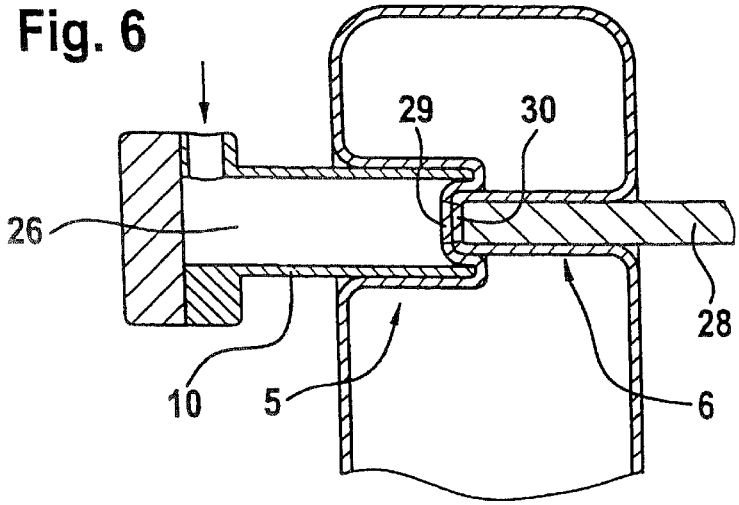
FIG. 6 shows a lateral longitudinal section of the hollow profile from FIG. 4 during the punching operation.
Figure 7:
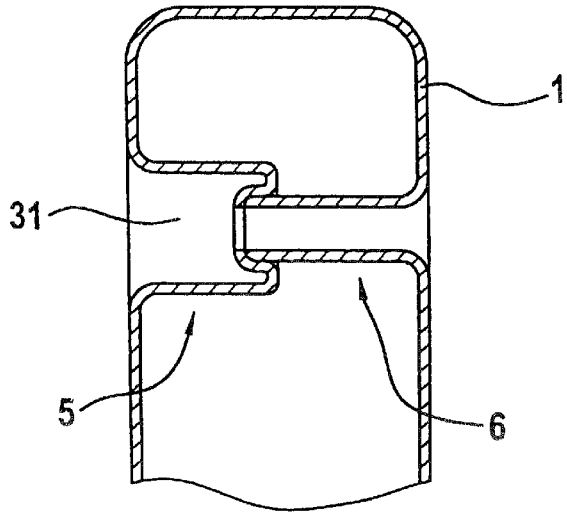
FIG. 7 shows a lateral longitudinal section of the finished hollow profile from FIG. 4.

Finally, to open the leadthrough 31, in an extending second phase of the plunging movement of the punch 28, the fluid pressure inside the sleeve 10 is increased, preferably to forming pressure, until cracks appear in the marginal region of the bases 8 and 9 on account of the reduction in the material thickness caused by high pressure and the shearing effect of the outer circumference of the plunging punch 28. In the course of the crack formation, the punched slugs 29 and 30 are then severed from both bases 8 and 9 of the secondary shaped elements 5 and 6 (FIG. 6) and remain for the time being in the punch interior 26, which forms the receiving hollow in this case. Compared with the hollow profile 1 from FIG. 3, the finish-formed hollow profile 1 according to FIG. 7 therefore has a modified leadthrough 31 to the effect that, on the one hand, the differences in diameter between the leadthrough regions stepped relative to one another are greater here and, on the other hand, that end region of the secondary shaped element 6 which contains the punched hole is enclosed by the secondary shaped element 5. The clamping gives the secondary shaped elements 5 and 6 and thus the leadthrough 31 a more stable hold and gives the double walling, connected thereto, of the hollow profile 1 at the location of the punched hole increased rigidity.

Compared with a mechanical spring-loaded support of the base 8, any desired number of spring characteristics can be simulated with the control of the fluid pressure, so that the support can be optimally adapted to the process sequence in an advantageous manner. It is of course possible within the scope of the invention, with the exception of the supporting principle, to have the design details of the first exemplary embodiment, for example the design of a sharp cutting edge on the inside of the sleeve 10, transferred to the exemplary embodiment just described.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Method of producing a leadthrough on a hollow profile, the hollow profile being acted upon by a fluidic pressure in an internal high-pressure forming tool, and a secondary shaped element being formed outwards in the radial direction from the hollow profile by the fluidic pressure, comprising:

reverse drawing the secondary shaped element into an interior of the hollow profile by way of a punch at a prevailing internal high pressure, and to open the leadthrough, cutting a punched slug out of a base of the reverse-drawn secondary shaped element by way of the punch, wherein two said secondary shaped elements are formed out of the hollow profile at two opposite locations, wherein the respective secondary shaped elements are each reverse drawn, after forming, into the hollow profile interior by a punch in such a way that the bases come to bear inside the hollow profile in a final state of the reverse drawing, and wherein the punched slug is severed from the respective base by one of the punches serving as a plunging punch plunging into the other punch.

2. Method according to claim 1, wherein the punched slug, after being severed, is pushed back again into a produced hole by the other punch which receives the plunging punch, while the plunging punch gives way, and wherein the punched slug is pushed out of the hole after the hollow profile has been removed from the internal high-pressure forming tool.

3. Method according to claim 2, wherein the punched slugs are cut out of the bases of the secondary shaped elements by interaction of a plunging movement of the plunging punch with an encircling cutting edge of the other punch serving as a receiving punch.

4. Method according to claim 2, wherein the punched slugs are torn out of the bases of the secondary shaped elements solely by a plunging movement of the plunging punch while the other punch remains in a bearing position.

5. Method according to claim 2, wherein the punched slugs are severed from the bases of the secondary shaped elements by interaction of a plunging movement of the plunging punch with a fluidic internal high pressure which is applied in the other punch receiving the plunging punch.

6. Method according to claim 2, wherein, in a first phase of a plunging movement, due to the shape of the plunging punch, the outer circumference of the punching punch is at a distance from the inner circumference of the other punch receiving the plunging punch it which is at least twice the wall thickness of the hollow profile to be formed, the secondary shaped element formed by the plunging punch is pressed into the opposite secondary shaped element while pushing back the base, and wherein, in an extending second phase of the plunging movement, the punched slug is then severed from both of the bases of the secondary shaped elements.

7. Device according to claim 6, wherein the support is formed by a pressure fluid, and wherein the sleeve is connected to a controllable fluid-pressure generator.

8. Method according to claim 1, wherein the punched slug, after being severed, is pressed into a receiving hollow of one of the punches, and wherein the punched slug is ejected from the punch after the hollow profile has been removed.

9. Method according to claim 8, wherein the punched slugs are cut out of the bases of the secondary shaped elements by interaction of a plunging movement of the plunging punch with an encircling cutting edge of the other punch serving as a receiving punch.

10. Method according to claim 8, wherein the punched slugs are torn out of the bases of the secondary shaped elements solely by a plunging movement of the plunging punch while the other punch remains in a bearing position.

11. Method according to claim 8, wherein the punched slugs are severed from the bases of the secondary shaped elements by interaction of a plunging movement of the plunging punch with a fluidic internal high pressure which is applied in the other punch receiving the plunging punch.

12. Method according to claim 8, wherein, in a first phase of plunging movement, due to the shape of the plunging punch, the outer circumference of the plunging punch is at a distance from the inner circumference of the other punch receiving the plunging punch which is at least twice the wall thickness of the hollow profile to be formed, the secondary shaped element formed by the plunging punch is pressed into the opposite secondary shaped element while pushing back the base, and wherein in an extending second phase of the plunging movement, the punched slug is then severed from both of the bases of the secondary shaped elements.

13. Method according to claim 1, wherein the punched slugs are cut out of the bases of the secondary shaped elements by interaction of a plunging movement of the plunging punch with an encircling cutting edge of the other punch serving as a receiving punch.

14. Method according to claim 1, wherein the punched slugs are torn out of the bases of the secondary shaped elements solely by a plunging movement of the plunging punch while the other punch remains in a bearing position.

15. Method according to claim 1, wherein the punched slugs are severed from the bases of the secondary shaped elements by interaction of a plunging movement of the plunging punch with a fluidic internal high pressure which is applied in the other punch receiving the plunging punch.

16. Method according to claim 1, wherein, in a first phase of a plunging movement, due to the shape of the plunging punch, the outer circumference of the plunging punch is at a distance from the inner circumference of the other punch receiving the plunging punch which is at least twice the wall thickness of the hollow profile to be formed, the secondary shaped element formed by the plunging punch is pressed into the opposite secondary shaped element while pushing back the base, and wherein, in an extending second phase of the plunging movement, the punched slug is then severed from both of the bases of the secondary shaped elements.

17. Device for producing a leadthrough on hollow profiles, comprising:

an internal high-pressure forming tool which has a branch branching off radially from a tool impression for forming a secondary shaped element by fluid pressure, and a punch which is guided in the branch of the impression and by way of said punch the secondary shaped element can be reverse drawn into an interior of the hollow profile at a prevailing internal high pressure, and, after the reverse drawing, a punched slug can be severed from a base of the reverse-drawn secondary shaped element, wherein two branches are formed in the forming tool and are arranged on two opposite sides of the impression, wherein in each case one of said punches for the reverse drawing of one of said secondary shaped element is guided in the two branches, wherein the punches are controlled in such a way that, after an end position during the reverse-drawing operation has been reached, the bases of the secondary shaped elements bear against one another inside the hollow profile, wherein a first of the punches comprises a sleeve, the inside diameter of the sleeve being larger than the outside diameter of the opposite punch in alignment with a clear width of the sleeve, and contains a support which is guided inside the sleeve and on said support the base of the corresponding secondary shaped element can be supported, and wherein the opposite punch, for severing the punched slugs from the bases of the secondary shaped elements, can be moved into the sleeve, whereas the support is controlled in such a way that the support gives way outwards when the opposite punch plunges into the sleeve.

18. Device according to claim 17, wherein one of the punches has a receiving hollow at an end face and into said receiving hollow the severed punched slug can be pressed.

19. Device according to claim 18, wherein the receiving hollow is formed by a cavity inside the sleeve, said cavity being produced when the support gives way during the punching operation.

20. Device according to claim 19, wherein an inner edge of the sleeve is designed as an encircling sharp cutting edge.

21. Device according to claim 19, wherein the inside diameter of the sleeve is larger than the outside diameter of the opposite punch by at least twice the wall thickness of the hollow profile, and wherein the end position of the sleeveless opposite punch during the reverse-drawing operation lies inside the sleeve of the first punch.

22. Device according to claim 18, wherein an inner edge of the sleeve is designed as an encircling sharp cutting edge.

23. Device according to claim 18, wherein the encircling cutting edge is arranged on the sleeveless opposite punch.

24. Device according to claim 18, wherein the inside diameter of the sleeve is larger than the outside diameter of the opposite punch by at least twice the wall thickness of the hollow profile, and wherein the end position of the sleeveless opposite punch during the reverse-drawing operation lies inside the sleeve of the first punch.

25. Device according to claim 18, wherein a plunger which forms the support is guided with slight clearance in the sleeve of the first punch.

26. Device according to claim 17, wherein an inner edge of the sleeve is designed as an encircling sharp cutting edge.

27. Device according to claim 17, wherein the inside diameter of the sleeve is larger than the outside diameter of the opposite punch by at least twice the wall thickness of the hollow profile, and wherein the end position of the sleeveless opposite punch during the reverse-drawing operation lies inside the sleeve of the first punch.

28. Device according to claim 17, wherein a plunger which forms the support is guided with slight clearance in the sleeve of the first punch.

29. Device according to claim 28, wherein the plunger is supported in a spring-loaded manner on a side facing away from the hollow profile.

30. Device according to claim 28, wherein the plunger is provided with a pneumatic or hydraulic drive on the side facing away from the hollow profile.

31. Method of producing a leadthrough in a hollow profile formed by high fluidic internal pressure and including two outwardly bulging sections at opposite sides of the hollow profile, comprising:

reverse drawing said bulging sections by movable punches operable to press respective bases of the bulging sections against one another in an interior of the profile, and further moving at least one of the punches in a reverse drawing direction to form a punched slug severed from a respective base with one punch plunging into the other punch.

32. Apparatus for producing a leadthrough in a hollow profile formed by high fluidic internal pressure and including two outwardly bulging sections at opposite sides of the hollow profile, comprising:

means for reverse drawing said bulging sections by movable punches operable to press respective bases of the bulging sections against one another in an interior of the profile, and means for further moving at least one of the punches in a reverse drawing direction to form a punched slug severed from a respective base with one punch plunging into the other punch.

* * * * *